US005804035A

United States Patent [19]

Michanickl et al.

[11] Patent Number: 5,804,035

[45] Date of Patent: Sep. 8, 1998

[54] PROCESS FOR RECOVERING CHIPS AND FIBERS FROM RESIDUES OF TIMBER-DERIVED MATERIALS, OLD PIECES OF FURNITURE, PRODUCTION RESIDUES, WASTE AND OTHER TIMBER CONTAINING MATERIALS

[75] Inventors: Andreas Michanickl, Braunschweig; Christian Boehme, Abbesbuttel, both of Germany

[73] Assignee: Fraunhofer-Gesellschaft zur Forderung der Angewandten Forschung e.V., Munich, Germany

[21] Appl. No.: 553,245

[22] PCT Filed: Mar. 14, 1995

[86] PCT No.: PCT/DE95/00360

§ 371 Date: Jan. 26, 1996

§ 102(e) Date: Jan. 26, 1996

[87] PCT Pub. No.: WO95/24998

PCT Pub. Date: Sep. 21, 1995

[30] Foreign Application Priority Data

Mar. 15, 1994 [DE] Germany ..... 44 08 788.8

[51] Int. Cl.[6] ..... D21C 3/00; D21C 5/00

[52] U.S. Cl. ..... 162/91; 162/10; 162/150; 162/165; 162/166; 162/189; 241/15

[58] Field of Search ..... 162/1, 10, 13, 162/91, 147, 150, 165, 166, 189; 241/15

*Primary Examiner*—Donald E. Czaja
*Assistant Examiner*—Steven B. Leavitt
*Attorney, Agent, or Firm*—Weingarten, Schurgin, Gagnebin & Hayes LLP

[57] ABSTRACT

A process is dislcosed for recovering chips and fibers from residues of timber-derived materials, old pieces of furniture, production residues, water and other timber-containing materials glued with urea-formaldehyde binders or other binders capable of being hydrolysed or chemically disintegrated by disintegrating the timber-derived materials at a high temperature. In a first step of the process, the residues of timber-derived materials are impregnated with an impregnating solution and previously swollen until they have absorbed at least 50% of their own weight of impregnating solution. In a second step, the thus impregnated residues of timber-derived materials are heated up to 80° C. to 120° C. The thus disintegrated residues of timber-derived materials are then sorted by sieving and/or wind screening. The residues of timber-derived material have edges of at least 10 to 20 cm length. In an improved of the invention, the residues of timber derived materials are impregnated and heated at the same time.

37 Claims, 2 Drawing Sheets

PRODUCTION OF CHIP BOARD FROM OLD FURNITURE, PRODUCTION RESIDUES AND SPOILAGE RECYCLING PROCESS

PROCESS FOR RECOVERING CHIPS AND FIBERS FROM RESIDUES OF TIMBER-DERIVED MATERIALS, OLD PIECES OF FURNITURE, PRODUCTION RESIDUES, WASTE AND OTHER TIMBER CONTAINING MATERIALS

CROSS REFERENCE TO RELATED APPLICATION

Priority is claimed to International Application Number PCT/DE95/00360 having international filing date Mar. 14, 1995 and corresponding German priority application No. P 44 08 788.8, filed Mar. 15, 1994.

STATEMENT REGARDING FEDERALLY SPONSORED RESEARCH AND DEVELOPMENT

Not applicable

BACKGROUND OF THE INVENTION

The present invention is related to recycling systems, and in particular to a process A known recovery process is specified in DE 42 24 629 A1. During this process, the residues of derived timber products are exposed to steam at high temperatures between 120° and 180° C. and the consequential high pressures (2–11 bar). The derived timber products are subjected to a pre-treatment in the course of which the material is crushed and any metal components are removed. Chips produced according to this method are rebonded with modified urea binders. However, the chips suffer not only from the high temperatures but are also mechanically damaged, i.e. shortened, during the previous crushing of the starting material. Another disadvantage of this method is that it is very difficult to separate coating materials and other undesired components from the chips after the steam treatment because the starting material has been so thoroughly crushed.

Another process for the recovery of chips from derived timber products is described in DE-AS 1 201 045. This procedure involves excess pressured steam to which the residues of the derived timber products are exposed. This process is preferably performed in a steam chamber at a pressure between 1 and 5 atmospheres above atmospheric pressure. The process duration varies between 0.5 and 4 hours. However, the processed materials are not fully disintegrated, which means that subsequent crushing is required. The chips are considerably damaged by the high temperature and the pressure and turn brown. Chip board with acceptable properties can only be produced of the recovered chips if fresh chips are added. Due to the degree of damage and their brown color, it is recommended to use the recovered chips preferably in the middle layer of chip board.

Another method is the boiling of chip board bonded with urea formaldehyde resins and medium density wood fiber board in large quantities of water to disintegrate them. However, this procedure is very energy consuming and cost intensive. The increased energy consumption is, in particular, due to the fact that such large quantities of water must be heated. The chips are boiled out, which has a negative impact on their characteristics. The swellability of the chips is increased due to removal of timber particles, while the technological qualities of the chips are reduced.

The binder is removed from the chips, which means that it cannot enhance the rebonding of the recovered chips. Additional considerable problems occurring in connection with this method are the disposal of the produced waste water and the drying of the soaked chips or fibers.

DE 42 01 201A1 furthermore specifies a method for the recycling of derived timber products and wood-containing waste. This method is based on a special mechanical treatment of the derived timber product residues, which are subsequently processed into new semifinished or finished products.

SUMMARY OF THE INVENTION

The purpose of the proposed invention is the introduction of an environmentally friendly and economically feasible method to recover chips and fibers from derived timber products. As an additional objective, this method is designed to yield high-quality chip and fiber material (secondary chips/fibers). This In accordance with the present invention, a process for recovering fibers from residues of derived timber materials bonded with binders that can be hydrolyzed or chemically disintegrated, comprises the steps of: impregnating the materials with a saturating or impregnating solution and allowing the materials to swell until the materials have absorbed at least 50% of their own weight in impregnating solution, thereby becoming impregnated materials; heating the impregnated materials to a temperature between 80° C. and 120° C.; and separating disintegrated material from other components by one or more techniques selected from the group consisting of sieving and wind screening.

BRIEF DESCRIPTION OF THE DRAWING

The invention will be more fully understood in view of the following Detailed Description of the Invention, and the Drawing, of which.

DETAILED DESCRIPTION OF THE INVENTION

Figure 1:
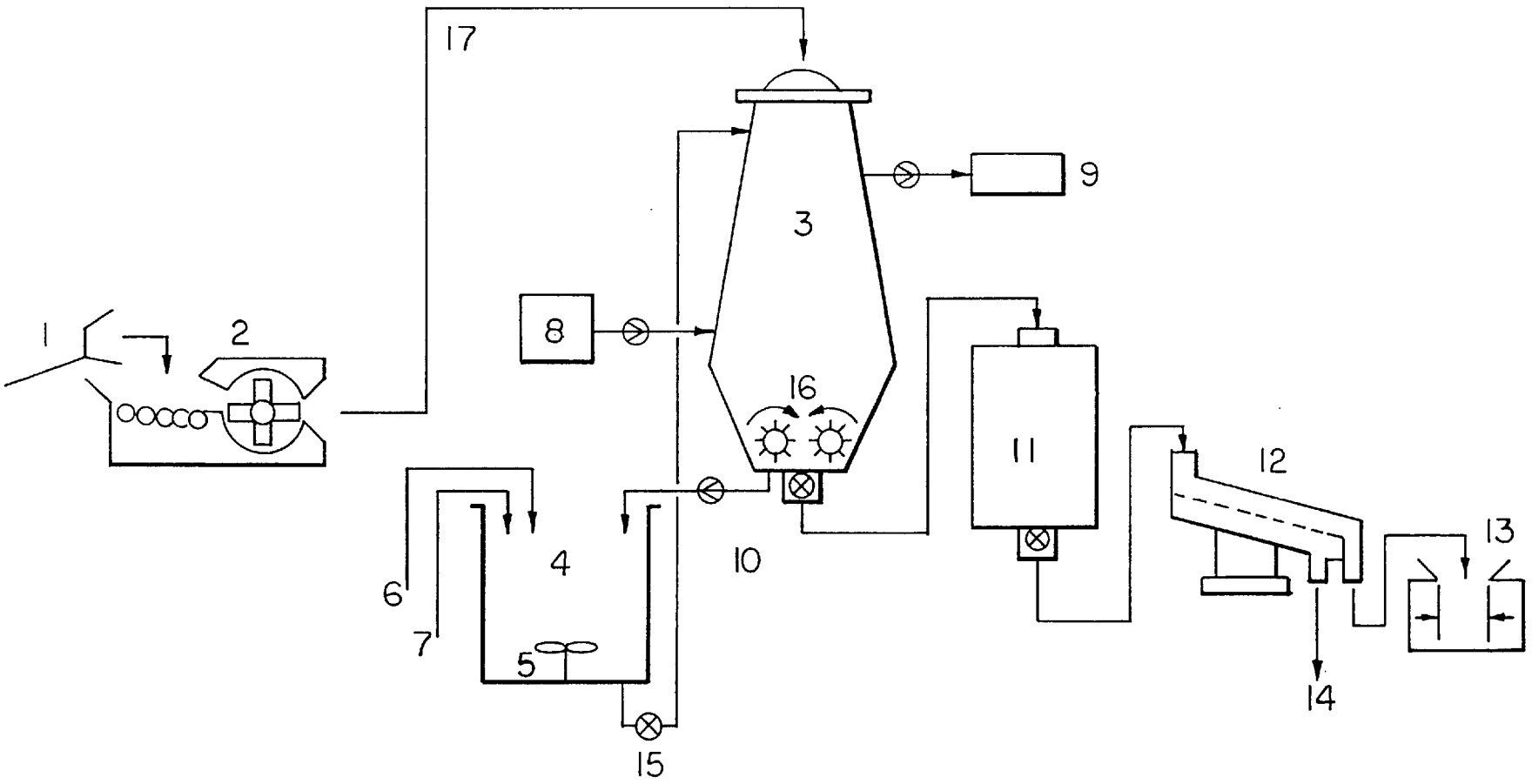
FIG. 1 is a block diagram which illustrates a plant for disintegrating chip board and residues of wood-containing materials.

In the first step of the process the derived timber products are impregnated with an impregnating solution or saturant and allowed to swell until they have absorbed at least 50% of their own weight in impregnating solution. In the second step the impregnated derived timber products are heated to 80°–120° C. until the bonding between the fibers and chips is dissolved due to the influence of the impregnating solution and the high temperature. This means that the bonding is chemically dissolved by hydrolysis and mechanically destroyed by swelling. The amount of impregnating solution absorbed by the derived timber products and the impregnation process are adjusted in such a way that the derived timber products are fully dissolved in the specified temperature range and that the entire liquid is absorbed during the disintegration process so that no surplus solution remains to be disposed of. The proposed method consists of a combination of chemical, thermal and mechanical processes. These processes allow disintegration of derived timber products at relatively harmless disintegration parameters and ensure that the chips or fibers will not be damaged but may even be upgraded during recovery. This is possible because the material is impregnated or saturated with the impregnating solution in such a way that no boiling solution or waste water remains to be disposed of after the disintegration process. The impregnating solution allows full hydrolysis already at a minimum temperature of 80° C., though the optimum operating temperature is 80°–120° C. The low temperatures ensure that the geometrical properties of the chips and fibers remain unchanged. The chemical and physical properties of the fibers and chips are not affected or even improved by the disintegration process. Secondary chips and secondary fibers can be produced with modest financial expenditure and technical requirements and can be used in conventional processing plants to produce new derived timber products such as chip board and wood fiber board with and without the addition of fresh fibers or fresh chips, respectively. The thus created derived timber products have equal or even better properties than derived timber products made of fresh material. This applies to both the technological properties and the emission of formaldehyde. Secondary fibers and chips can be bonded with conventional binders. The consumption of binders is not increased but can, on the contrary, even be reduced through the proposed method.

The actual recovery begins with the addition of the impregnating solution to the derived timber products. The quantity of impregnating solution must be calculated in such a way that the derived timber products will have absorbed at least 50% of their own weight in impregnating solution when the last of the solution is gone. It is important to stir the derived timber products in the container so that the added solution is evenly absorbed. Even absorption can be enhanced by a rotating container. As an alternative method, it is possible to add an excess quantity of impregnating solution so that the wood-containing material is fully submerged in the liquid. The surplus amount of liquid can be drained when the pieces of timber have absorbed at least 50% of their own weight in liquid. The drained liquid need not be discarded but can be used to disintegrate further batches of derived timber products. Saturated with impregnating solution, the derived timber products are transferred from the impregnation container into a disintegration boiler where they are heated to a temperature of between 80° and 120° C. The influence of the temperature and the effect of the impregnating solution cause hydrolytic disintegration of the bonding. As a different variation of the same method it is proposed that the impregnation process need not necessarily take place in an individual container and that it is possible, instead, to use the disintegration as an impregnation container in which the starting material is first impregnated. Then the temperature is raised as soon as the liquid has been fully absorbed by the derived timber products or the surplus impregnating solution has been drained. The temperature increase can take place either under pressure (i.e. in the pressure sealed disintegration boiler) or under abmbient atmospheric conditions. The level of the pressure depends on the selected temperature.

The duration of the disintegration phase depends on the previous impregnation, the composition of the impregnating solution, the temperature and the heating time of the disintegration boiler and varies between 1 and 60 minutes. The disintegration process will be accelerated by higher temperatures, a higher proportion of impregnating solution and a higher acid content in the impregnating solution, while lower temperatures, a smaller amount of impregnating solution and a basic impregnating solution will slow it down.

The initial pressure level during the heating process is at ambient atmospheric The maximum pressure should not exceed 2 bar excess pressure to ensure gentle disintegration. For gentle but nevertheless fast disintegration it is recommended to choose a temperature not exceeding 120° C.

To accelerate the impregnation process it is recommended to evacuate the impregnation container (underpressure) or to increase the pressure in the impregnation container beyond normal. Vacuum treatment (i.e. underpressure of e.g. 150 mbar (absolute) in the impregnation container ) causes the air contained in the derived timber products to evaporate. Under normal pressure, this air prevents penetration by the impregnating solution and would render disintegration of coated derived timber products with large surfaces virtually impossible without underpressure. Air-filled cavities account for approximately 30–70 % of the total volume of the derived timber products. Excess pressure can also facilitate the penetration of the derived timber products by the impregnating solution. It is also possible to speed up the impregnation process by a combination of excess pressure and underpressure. The same effect can be achieved by heating the impregnating solution or the derived timber products before or during the impregnation process. Thereby, the heat emitted by the exhaust gases of the disintegration boiler or during discharging of the disintegrated material can be used for energy-saving heating of the impregnating solution. The heat emitted by the exhaust gases of the disintegration boiler or during discharging or sorting of the disintegrated material can also be used to heat the material to be disintegrated.

Another variation of the same method involves a rotating disintegration boiler or a disintegration boiler with a stirring device in which the derived timber products are mixed with the impregnating solution. (Thereby, the amount of impregnating solution to be added must be calculated in such a way that no impregnating solution or waste lye will be left in the container for disposal after the disintegration process). The disintegration boiler is heated to a temperature of 80°–120° C. In this process the mechanical destruction of the bonding by swelling and the chemical dissolution by hydrolysis take place simultaneously. This means that the derived timber products are simultaneously exposed to the impregnating solution and the temperature (and the respective pressure).

The impregnating solution allows disintegration at low temperatures with and without pressure. This means that the chips and fibers are treated very gently and that the binders contained in the waste materials (e.g. urea) are not damaged or only slightly damaged and can enhance the rebonding process or even be reactivated (i.e. reduction of binder consumption and formaldehyde emission). At the same time it is possible to avoid the undesired emissions characteristic of work at higher temperatures and pressures.

After the disintegration process the derived timber products are completely dissolved. The chips and fibers, the coating materials, the solid timber components, the edge veneers, any metal components and any other components are separated from the chip or fiber material and can be sorted by sieving, wind screening, a combination of sieving and wind screening or any new separating method. It is particularly easy to remove the wood chips and fibers, because the fibers and chips are much smaller than, for example, the coating materials that have not disintegrated but retained the size of the crushed derived timber products originally fed into the boiler.

The water content of the chips and fibers after the disintegration process corresponds to that of fresh timber or is even lower. The increased temperature of the chips after the disintegration facilitates their drying. The recovered chips can either be dried separately in the conventional method or together with fresh chips or wood fibers. The recovered chips and fibers can be processed into chip and wood fiber board with unmodified commercial binders and without addition of fresh chips and fibers. The thus produced chip board or wood fiber board has equal or even better properties than the starting material. This applies to both the technical properties and formaldehyde emission.

Particularly fast and full disintegration can be ensured by allowing the derived timber products to absorb 80% of their own weight in impregnating solution. The absorption of the impregnating solution can take place at normal temperature (ambient temperature) and normal pressure. The absorption can be accelerated by vacuum treatment preceding the impregnation, by alternating pressure treatment, by heating of the impregnating solution, by heating of the material to be disintegrated or by any combination of the above possibilities.

The recommended size of the derived timber products to be disintegrated is 10–20 cm (average edge length). The derived timber products can be crushed to the required size by means of a slowly rotating commercial crusher. The recommended size ensures that the fibers and chips will not be severely damaged. This applies even to the chips and fibers located along the edges of the boards, because the special, slow roller of the crusher does not usually crush the chips or fibers but usually breaks entire fibers or chips out of the bonding substance. Coating materials and other undesired materials in the chip or fiber material largely retain their original size because they are not disintegrated and can, therefore, easily be separated after disintegration. Such large pieces of derived timber products can be used because the impregnating treatment ensures that the starting material is saturated with impregnating solution so that the binder can be destroyed throughout by chemical and hydrolytic effects enhanced by heat.

The impregnating solution offers numerous possibilities to control the disintegration process and, in particular, the result of the disintegration process. It is, for instance, possible to modify the composition of the disintegration solution in such a way that the quality of the chips and fibers is even improved during the disintegration process. This means that particular impregnating and/or disintegrating conditions can ensure that the chemical and physical properties of the recovered chips will be better than those of fresh chips. Chip board and medium density wood fiber board made of old furniture are marked by relatively high formaldehyde emissions and contents. Therefore, it can definitely be recommended to supplement the impregnating solution by formaldehyde-binding, formaldehyde-inhibiting or formaldehyde-destroying chemicals such as urea or ammonia or with chemicals that can separate urea or ammonia. Thus, it is possible to reduce the formaldehyde concentration in or eliminate formaldehyde altogether from the exhaust air and drying air after the disintegration process. Basic substances can be added to counteract the formation of acids. Acids contained in the wood can be neutralized. The chips can, for instance, be adjusted to a slightly basic level. Thus, it is possible to delay the hardening of added binders, which is a particularly interesting option in the case of long intervals between the application of the binder and the actual pressing of the boards. It is, furthermore, possible to apply coatings that require a basic ground to derived timber products of secondary fibers or secondary chips. Acids can be added, on the other hand, to increase the acidity of the recovered chips and fibers. This means that less or no hardeners must be added to the binder or that the hardening of the, binder will be accelerated. The addition of acids is also recommended if the recovered chips and fibers are to be used for the production of materials that will be treated with coatings based on -acid-hardening adhesive systems. In such cases it would be possible to simplify the adhesive system and the application of the coating would be accelerated as well. The addition of acids to the impregnating solution would also accelerate the disintegration process. Another positive option is the addition of oxidizing agents or reducing agents. Such agents can, on the one hand, serve to destroy emitted formaldehyde. On the other hand, the addition of peroxides can, to a certain degree, reactivate urea. Another recommendable option in terms of the composition of the impregnating solution is the addition of binders such as urea formaldehyde resins or binder additives such as paraffines. This will reduce the amount of formaldehyde emission and have a positive influence on the subsequent swelling and water absorption characteristics of the secondary chips and fibers. Additional bonding of the recovered chips and fibers can be reduced or will not be required at all. The chips and fibers need not be completely dried for further processing. If the recovered chips are to be split up into fibers for wood fiber board production it is recommended to add lignin-softening chemicals such as methanol, sulphites or ammonia in order to save energy during the subsequent fiber production.

The standard impregnating solution contains approximately 0.5–3% urea and approximately 0.1–1% ammonia or approximately 0.5% soda lye (dissolved in water). The chemicals contained in the impregnating solution do not cause delignification as in pulp production.

The disintegration process can be positively influenced by the addition of chemicals to the mass in the disintegration boiler during the disintegration process. It is, for instance, possible to add ozone in order to destroy the emitted formaldehyde.

As high temperatures damage the chips, it is recommended to base the disintegration process on a controlled temperature scheme. The temperature can, for instance, be increased to a higher level at the beginning and reduced toward the end of the disintegration process. Other non-constant temperature schemes are also possible. The proposed procedure is described in greater detail by means of the following examples 1–11:

EXAMPLE 1

Old furniture, production residues and spoilage containing chip board and/or medium density wood fiber board or other wood-containing materials are crushed into pieces (edge length approx. 10–20 cm) by means of a commercial crusher (e.g. crushers by Pailmann or Maier). Crushing to the above size ensures on the one hand optimum piled weight (mass per volume). On the other hand, the chips and fibers as well as the coating materials and edge veneers do not suffer significant mechanical damage. Components of metal, plastic or solid wood need not be removed. Chip board and medium density wood fiber board as well as other wood-containing materials can be disintegrated together or separately. The crushed pieces are filled into a static or rotating disintegration boiler/pressure vessel. The recommended dimensions yield a piled weight of approximately 350–400 kg/m3. The pressure vessel is closed and evacuated so that the pressure in the container is reduced to an underpressure of 150–200 mbar (absolute). The time needed to create this underpressure depends on the respective technology. The air contained in the wood-containing materials escapes and the added impregnating solution can penetrate the materials very quickly. The time required for full penetration varies between 5 and 15 minutes for chip board and depends on the type of derived timber product, the underpressure and the composition and temperature of the impregnating solution. The impregnating solution consists of water, urea and soda lye. The wood-containing material is exposed to this solution until it has absorbed at least 50% of its own weight. The required bath ratio (i.e. the ratio between wood-containing material and impregnating solution after completion of the impregnation process) is 1:0.5. Then, the pressure in the disintegrating boiler is restored to normal and the remaining impregnating solution is drained from the container. The drained solution can be used for the next disintegration process. Then, the disintegrating container is closed again and heated to a temperature of 110° C. for approximately 20 minutes. The container will heat up very quickly because of the open spaces between the board pieces. After this treatment the chips and fibers can be retrieved in their original geometrical shape. The coating materials and edge veneers as well as any other undesired materials have been separated from the chips and fibers and can be removed by sieving or wind screening or a combination of both. The same applies to solid timber components or pieces of chip board or wood fiber board that have remained whole. The residues can be subjected to further sorting (e.g. solid timber, plastic, metal etc.). These materials can be recycled, used to generate thermal energy or power or be disposed of. Metals can, for instance, be removed by means of magnets or metal detectors. Plastic and solid timber components can be identified and separated by NIR spectroscopy or other methods.

The recovered chips and fibers can be processed into chip board or wood fiber board without addition of fresh chips or fibers, using conventional technologies and unmodified commercial binders such as urea formaldehyde resins, melamine formaldehyde resins, phenol formaldehyde resins, isocyanates (MDI/PMDI) or mixed resins. The produced board will have equal or even better properties than the starting material (see tables 1 and 2). This applies to both the technological properties and formaldehyde emission values.

EXAMPLE 2

Procedure as in example 1. Difference: The starting material and the impregnating solution are mixed in the desired bath ratio and filled into a rotating disintegrating boiler or one with an integrated stirring device. This means that the amount of impregnating solution added must correspond to the absorption capacity of the material to be processed. Mixing and even absorption of the impregnating solution is ensured by the rotation of the disintegration container or the stirring device, respectively. The disintegrating container can be heated right from the beginning, i.e. the heat can be turned on as soon as the container is closed.

EXAMPLE 3

Procedure as in example 1. Difference: The impregnation process and the disintegration process take place in separate containers. The impregnated pieces of wood-containing material are transferred from the impregnation container into the disintegration boiler, which means that a direct heat increase is possible.

EXAMPLE 4

Procedure as in example 1. Difference: no underpressure.

EXAMPLE 5

Procedure as in examples 1, 2, 3 and 4. Difference: Disintegration takes place without pressure.

EXAMPLE 6

Procedure as in examples 1 and 4. Difference: The temperature of the impregnating solution is higher than the ambient temperature. Recommended temperature: 60°14 80° C.

EXAMPLE 7

Procedure as in examples 1, 2 and 4. Difference: Impregnation and disintegration take place continuously (or "batch" production).

EXAMPLE 8

Procedure as in examples 1, 2, 3 and 4. Difference: Formaldehyde-binding, formaldehyde-inhibiting or formaldehyde-destroying chemicals such as urea or ammonia or substances separating urea or ammonia are added to the impregnating solution.

EXAMPLE 9

Procedure as described in examples 1, 2, 3 and 4. Difference: Lyes such as soda lye, acids such as sulphuric acid, oxidizing or reduction agents, binders such as urea formaldehyde resins or substances preserving or reactivating the existing binders are added to the impregnating solution. Maximum total concentration of all chemicals: 30%.

EXAMPLE 10

Procedure as described in examples 1, 2, 3 and 4. Difference: The recovered chips or fibers are treated with the chemicals mentioned in examples 8 and 9 after the disintegration process while they are either still wet, slightly dried or after complete drying.

EXAMPLE 11

Procedure as described above. Difference: The chemicals mentioned in examples 8 and 9 or other chemicals are added to the material in the disintegration boiler during the disintegration process. It is, for instance, possible to add ozone to destroy formaldehyde emitted by the disintegrating material.

EXAMPLE 12

Procedure as described above. Difference: Two or more disintegration boilers are combined into one large production unit and operated simultaneously.

Tables 1 and 2 illustrate the characteristics of board produced of recovered chips.

Table 1: Characteristics of a laboratory chip board produced of recovered chips, characteristics of the furniture chip board (year of production: 1993) from which the chips were recovered (after removal of the coating material) and characteristics of a laboratory chip board manufactured of industrial chips supplied by the manufacturer of the furniture chip board.

Table 2: Characteristics of a laboratory chip board produced of recovered chips (secondary chips), characteristics of the old furniture chip board (year of production: 1964) from which the chips were recovered (after removal of the coating material) and characteristics of a laboratory medium density fiber board manufactured of fibers produced by grinding the chips recovered from the old furniture chip board.

The process is explained by means of an example.

Figure 2:
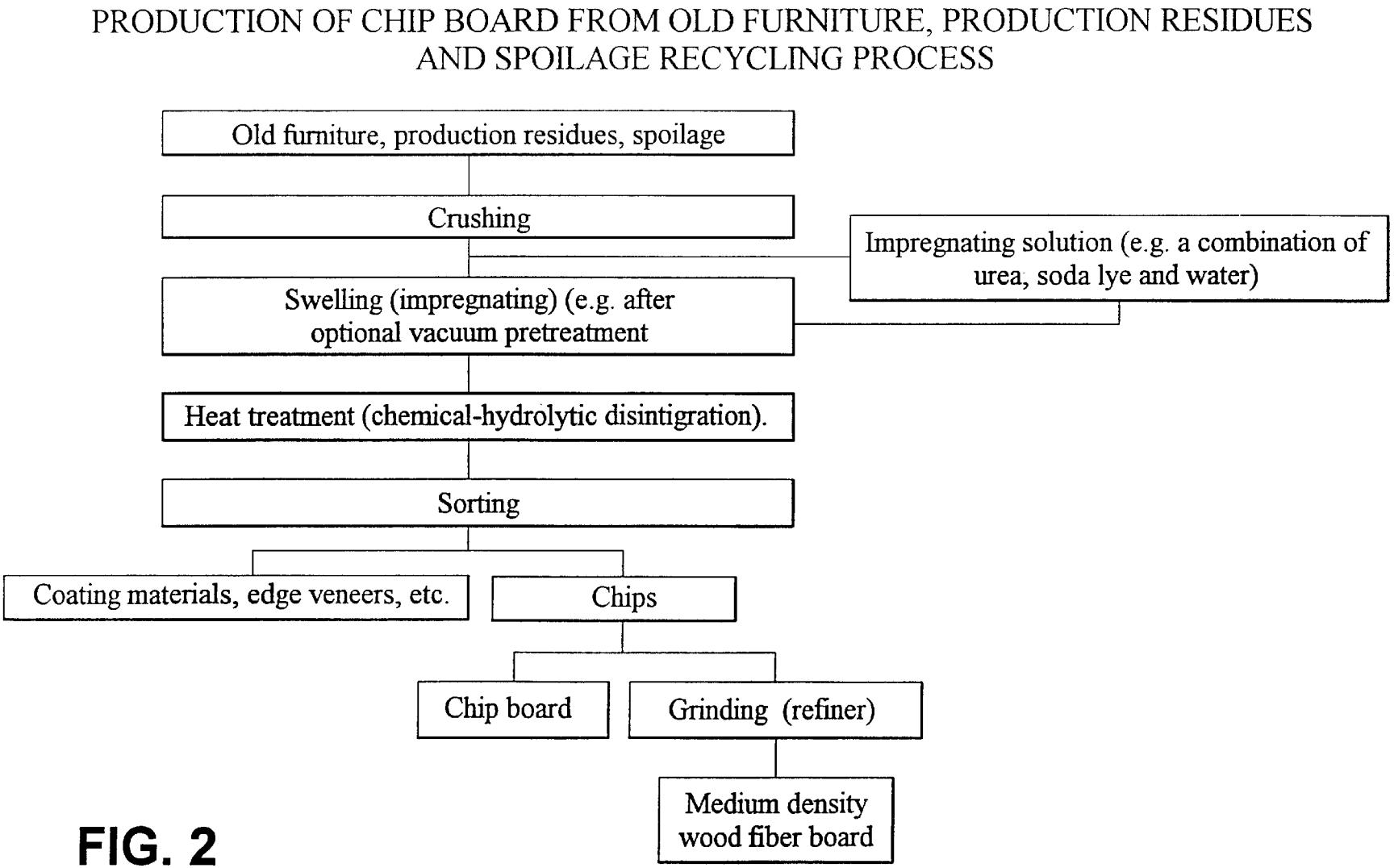
FIG. 2 is a flow diagram which illustrates stages for the process of FIG. 1.

FIG. 1 illustrates a plant for the disintegration of chip board and residues of wood-containing materials according to the proposed method. FIG. 2 illustrates the stages of the process.

The wood-containing material is transferred into a crusher (2) by means of a wheel loader (1), a grab excavator or any other adequate equipment. The crusher (2) crushes the wood-containing material into flat pieces ( average edge length 10–20 cm). The crushed material is then conveyed into the disintegration boiler (3) by means of adequate conveying equipment (17). In the illustrated model, the disintegration boiler (3) also serves as the impregnation container. The filled disintegration container (3) is locked airtight. A vacuum pump (9) is used to suck off the air contained in the disintegration boiler (3) and the wood-containing material until an absolute underpressure of 150–200 mbar is reached. Still under vacuum, the disintegration boiler (3) is filled with impregnating solution from the impregnating solution tank (4) via a pipe (15) until the wood-containing material is fully submerged in impregnating solution. Then the pressure in the disintegration boiler (3) is restored to normal. It would also be possible to use overpressure to accelerate the impregnation process. The impregnating solution tank (4) contains a stirring device (5) as well as supply pipes for chemicals (6) and water (7). After the impregnation process, i.e. when the wood-containing material has absorbed at least 50% of its weight in impregnating solution, the remaining solution from the disintegration boiler (3) back into the impregnating solution tank (4) via a pipe (10) provided for that purpose. From there, the drained impregnating solution is later retransferred into the disintegration boiler for the next impregnation process together with the new solution mixed for that purpose. After draining, the disintegration boiler (3) is once again hermetically closed. Then, it is heated either via the outer surface or through direct heat. The heat from the heat source (8) is thereby transferred to the boiler by means of hot air, steam of any other gaseous heat transfer medium. The disintegration boiler (3) is, for example, heated to a temperature of 110° C. for a period of 20 minutes. Then, the heat source is switched off and the disintegration boiler (3) is emptied by means of an unloading device (16). The disintegration boiler could also be emptied via an opening that extends over the entire width of the bottom section of the boiler. The disintegrated material is conducted into a silo (11) or into any other suitable storage container. From there, it is continually fed into a sieving machine (12). There, the chips and fibers are separated from coating materials, solid wood, edge veneers and other undesired components. The removed chips or fibers are then transferred to the reprocessing plant (14). The other components can either be sorted or compressed in a press (13) to reduce their volume.

TABLE 1

| | Furniture chip board without coating 19 mm | Laboratory chip board of secondary chips 19 mm | Laboratory chip board of fresh chips 19 mm |
|---|---|---|---|
| Bulk density [g/cm$^3$] | 0.703 | 0.674 | 0.673 |
| Module of elasticity [N/mm2] | 2410 | 2460 | 2600 |
| Flexural strength [N/mm2] | 11.99 | 12.55 | 15.20 |
| Transverse pull resistance [N/mm2] | 0.529 | 0.520 | 0.668 |
| Delamination strength [N/mm2] | 1.10 | 1.17 | 1.27 |
| Shear resistance [N/mm2] | 1.71 | 1.48 | 1.70 |
| Perforator values [mg/100 g] | 6,8 | 5.4 | 8.1 |
| Humidity at 20/65 [%] | 10.0 | 9.5 | 10.1 |

TABLE 2

| | Old furniture chip board (1964), without coating 19 mm | Laboratory chip board of secondary chips 19 mm | Laboratory medium density fiber board 19 mm |
|---|---|---|---|
| Bulk density [g/cm$^3$] | 0.621 | 0.712 | 0.760 |
| Module of elasticity [N/mm2] | 3020 | 3730 | 3530 |
| Flexural strength [N/mm2] | 18.11 | 23.63 | 23.20 |
| Transverse pull resistance [N/mm2] | 0.30 | 0.34 | 0.53 |
| Delamination strength [N/mm2] | 1.05 | 1.20 | 1.30 |
| Shear resistance [N/mm2] | 1.21 | 1.33 | 1.77 |
| Perforator values [mg/100 g] | 14.6 | 9.5 | 2.0 |
| Humidity at 20/65 [%] | 10.27 | 9.77 | 8.06 |

What is claimed is:

1. A process for recovering particles from residues of derived timber materials bonded with binders that can be hydrolyzed or chemically disintegrated, comprising the steps of:

impregnating the materials with an impregnating solution and allowing the materials to swell until the materials have absorbed at least 50% of their own weight in impregnating solution, thereby becoming impregnated materials;

heating the impregnated materials to a temperature between 80° C. and 120° C.; and separating disintegrated material from other components by one or more techniques selected from the group consisting of sieving and wind screening.

2. The process according to claim 1, wherein said impregnating step and said disintegrating step take place in two separate containers, the impregnated material being heated in a disintegration boiler.

3. The process according to claim 2, wherein the impregnating container is a rotating container, the rotating action of which ensures proper mixing of the of the wood-containing material and the impregnating solution.

4. The process according to claim 2, wherein the impregnating container is equipped with a mixing device to ensure proper mixing of the of the wood-containing material and the impregnating solution.

5. The process according to claim 2, wherein the disintegration container is a rotating container.

6. The process according to claim 2, wherein the disintegration container is equipped with a mixing device.

7. The process according to claim 1, wherein said impregnating and heating steps both take place in a disintegration boiler.

8. The process according to claim 7, wherein said impregnating step takes place before the disintegration boiler is heated.

9. The process according to the claim 7, wherein said impregnating and heating steps take place simultaneously.

10. The process according to claim 1, wherein the derived timber materials subjected to said impregnating step are substantially flat and have an edge length of approximately 10–20 cm.

11. The process according to claim 1, wherein said impregnating step lasts at least 1 minute.

12. The process according to claim 1, wherein the material is exposed to an increased temperature for a least 1 minute.

13. The process according to claim 1, wherein an amount of impregnating solution calculated to be entirely absorbed is added to the wood-containing material.

14. The process according to claim 1, wherein an amount of impregnating solution calculated to entirely submerge the material is added to the wood-containing material in a container, any surplus amount of impregnating solution being drained from the container after the impregnating step.

15. The process according to claim 14, wherein entire process takes place in a static container.

16. The process according to claim 1, wherein a disintegrating container is employed and a pressure in the disintegrating container is raised to an overpressure of up to 2 bar.

17. The process according to claim 1, wherein the wood-containing materials contain a proportion of the impregnating solution corresponding to 80% of their own weight, and the materials are exposed to a temperature of 110° C. for 20 minutes.

18. The process according to claim 1, wherein increased temperature is allowed to take effect at ambient atmospheric pressure.

19. The process according to claim 1, wherein impregnating with the impregnating solution takes place at an underpressure below ambient atmospheric pressure.

20. The process according to claim 1, wherein impregnating with the impregnating solution takes place at excess pressure above ambient atmospheric pressure.

21. The process according to claim 1, wherein impregnating with the impregnating solution takes place at a combination of underpressure and excess pressure applied at different respective times.

22. The process according to claim 1, wherein the wood-containing material is heated before the impregnating step.

23. The process according to claim 1, wherein the impregnating solution is heated during and before the impregnation process.

24. The process according to claim 1, wherein the impregnating solution is supplemented by one or more substances selected from the group consisting of: formaldehyde-binding chemicals, formaldehyde-inhibiting chemicals, formaldehyde-destroying chemicals, urea, ammonia, chemicals that can separate urea, and chemicals that can separate ammonia.

25. The process according to claim 1, wherein the impregnating solution is supplemented by one or more chemicals selected from the group consisting of: lyes, acids, oxidation agents, reduction agents, binders, urea formaldehyde resins, substances preserving existing binders, and substances reactivating existing binders, maximum total concentration of all chemicals: 30%.

26. The process according to claim 25, wherein the chemicals are added in a disintegration container during a disintegration process.

27. The process according to claim 1, wherein a predetermined temperature scheme including heating to a temperature of up to 120° C. is used during the heating step.

28. The process according to claim 1, wherein recovered particles are treated with one or more chemicals selected from the group consisting of: formaldehyde-binding chemicals, formaldehyde-inhibiting chemicals, formaldehyde-destroying chemicals, urea, ammonia, chemicals that can separate urea, chemicals that can separate ammonia, lyes, soda lye, acids, sulphuric acid, oxidation agents, reduction agents, binders, urea formaldehyde resins, substances preserving existing binders, and substances reactivating the existing binders after the disintegration process.

29. The process according to claim 1, wherein impregnating with the impregnating solution takes place after an under pressure treatment (evacuation) of the wood-containing material relative to ambient atmosphere pressure.

30. The process according to claim 1, wherein the impregnating solution is heated during the impregnation process.

31. The process according to claim 1, wherein the impregnating solution is heated before the impregnation process.

32. A process for recovering particles from residues of derived timber materials, comprising the steps of:

impregnating the materials for at least one minute with an amount of impregnating solution calculated to submerge the materials, said impregnating step including allowing the materials to swell in a container while being mixed until the materials have absorbed at least 50% of their own weight in impregnating solution, said materials thereby becoming impregnated materials;

heating the impregnated materials to a temperature between 80° C. and 120° C.; and separating disintegrated material from other components.

33. The process of claim 32, wherein different containers are used for said impregnating step and said heating step.

34. The process of claim 33, wherein said impregnating step takes place at an underpressure below ambient atmospheric pressure.

35. The process of claim 33, wherein said impregnating step takes place at excess pressure above ambient atmospheric pressure.

36. The process of claim 33, wherein said impregnating step takes place at a combination of underpressure and excess pressure at different respective times.

37. The process of claim 33, wherein said impregnating solution is supplemented by one or more chemicals selected from the group consisting of: formaldehyde-binding chemicals, formaldehyde-inhibiting chemicals, formaldehyde-destroying chemicals, urea, ammonia, chemicals that can separate urea, chemicals that can separate ammonia, lyes, acids, oxidation agents, reduction agents, binders, substances that preserve existing binders, and substances that reactivate existing binders.

* * * * *

UNITED STATES PATENT AND TRADEMARK OFFICE

CERTIFICATE OF CORRECTION

PATENT NO. : 5,804,035

DATED : September 8, 1998

INVENTOR(S) : Andreas Michanickl , et al.

It is certified that error appears in the above-identified patent and that said Letters Patent is hereby corrected as shown below:

Column 6, line 51, "Pailmann" should read --Pallmann--.

Column 8, lines 5 and 6, "60°14 80° C." should read --60° - 80° C.--.

Signed and Sealed this

Fourteenth Day of September, 1999

*Attest:*

Q. TODD DICKINSON

*Attesting Officer*

*Acting Commissioner of Patents and Trademarks*